US008189818B2

(12) United States Patent
Takahashi et al.

(10) Patent No.: US 8,189,818 B2
(45) Date of Patent: May 29, 2012

(54) ELECTRONIC APPARATUS CAPABLE OF ALWAYS EXECUTING PROPER NOISE CANCELING REGARDLESS OF DISPLAY SCREEN STATE, AND VOICE INPUT METHOD FOR THE APPARATUS

(75) Inventors: Toshio Takahashi, Akishima (JP); Kazuyuki Saito, Ome (JP); Makoto Yamaguchi, Sagamihara (JP); Kei Sakamoto, Hamura (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1172 days.

(21) Appl. No.: 10/944,871

(22) Filed: Sep. 21, 2004

(65) Prior Publication Data

US 2005/0069149 A1 Mar. 31, 2005

(30) Foreign Application Priority Data

Sep. 30, 2003 (JP) ..... 2003-339988

(51) Int. Cl.
*H04R 3/00* (2006.01)

(52) U.S. Cl. ..... 381/122; 381/71.1; 381/91; 381/123; 345/156; 345/158

(58) Field of Classification Search ..... 381/71.1, 381/77, 94.1, 91–92, 80–81, 122–123, 361, 381/365, 26; 248/919; 345/156, 158; 700/94
See application file for complete search history.

(56) References Cited

U.S. PATENT DOCUMENTS

| | | | | |
|---|---|---|---|---|
| 6,522,756 | B1 * | 2/2003 | Maisano et al. | 381/92 |
| 6,535,610 | B1 * | 3/2003 | Stewart | 381/92 |
| 6,587,333 | B2 * | 7/2003 | Tseng et al. | 361/681 |
| 6,882,335 | B2 * | 4/2005 | Saarinen | 345/156 |
| 7,206,418 | B2 * | 4/2007 | Yang et al. | 381/92 |
| 7,369,907 | B2 * | 5/2008 | Hibino et al. | 700/94 |
| 2003/0156075 | A1 * | 8/2003 | Motoyama et al. | 345/1.3 |

FOREIGN PATENT DOCUMENTS

| | | |
|---|---|---|
| CN | 1251927 A | 5/2000 |
| JP | 6-95840 | 4/1994 |
| JP | 2000-287292 | 10/2000 |
| JP | 2002-165292 | 6/2002 |
| JP | 2003-169161 | 6/2003 |
| JP | 2003-244786 | 8/2003 |

OTHER PUBLICATIONS

Notification of the First Office Action from the Chinese Patent Office in counterpart application, mailed Dec. 9, 2005, including English language translation.

Notice of Reasons for Rejection for Application No. 2003-339988, Japanese Patent Office, mailed Aug. 5, 2008.

* cited by examiner

*Primary Examiner* — Vivian Chin

*Assistant Examiner* — Fatimat O Olaniran

(74) *Attorney, Agent, or Firm* — Finnegan, Henderson, Farabow, Garrett & Dunner, L.L.P.

(57) ABSTRACT

In an electronic apparatus, microphones are arranged parallel to one side of a display screen so as to be spaced apart from each other on the front surface of a display whose display screen is exposed. Together with the microphone, a microphone is arranged parallel to other side different from one side of the display screen. Of the microphones, the microphones are selected when one side of the display screen serves as a bottom, and the microphones are selected when other side of the display screen serves as the bottom. A voice input process is then executed.

3 Claims, 5 Drawing Sheets

ELECTRONIC APPARATUS CAPABLE OF ALWAYS EXECUTING PROPER NOISE CANCELING REGARDLESS OF DISPLAY SCREEN STATE, AND VOICE INPUT METHOD FOR THE APPARATUS

CROSS-REFERENCE TO RELATED APPLICATIONS

This application is based upon and claims the benefit of priority from prior Japanese Patent Application No. 2003-339988, filed Sep. 30, 2003, the entire contents of which are incorporated herein by reference.

BACKGROUND OF THE INVENTION

1. Field of the Invention

The present invention relates to a noise canceling technique in voice input to an electronic apparatus such as a personal computer.

2. Description of the Related Art

In recent years, portable electronic apparatuses such as notebook personal computers and personal digital assistants (PDAs) have become popular. In some electronic apparatuses of this type, a rectangular display screen exposed on the front surface of the display can be utilized in both the portrait and landscape directions.

Most electronic apparatuses of this type have a sound function such as a voice input function via a microphone or a voice output function via a loudspeaker. These days, electronic apparatuses having an advanced voice input function of canceling noise by using two microphones are becoming available. The method of canceling noise by using two microphones is called a microphone array system. Two microphones are set so that they are located at the two base vertices of an isosceles triangle virtually drawn using a sound source as the upper vertex. Of sounds input from the two microphones, a sound with a larger difference in volume level between the sounds is removed as noise. By using the microphone array system, only the user's voice can be very clearly picked up even when the electronic apparatus is used in a slightly noisy environment.

As a method of acquiring a desired sound, which is different from the microphone array system for canceling noise, there is proposed a method of two-dimensionally arraying a plurality of microphones and properly selecting acoustic signals output from the microphones (see, e.g., Jpn. Pat. Appln. KOKAI Publication No. 2002-165292).

As described above, when noise canceling of the microphone array system is applied to an electronic apparatus, the installation locations of two microphones on a housing must be considered so that the two microphones are located at the two base vertices of an isosceles triangle using the mouth of the user as the upper vertex. In an electronic apparatus with a display screen exposed on the front surface of the display, two microphones are preferably set near, e.g., the bottom of the display screen so as to be spaced apart from each other by the same distance from the vertical center line of the display screen.

However, in an electronic apparatus whose rectangular display screen can be utilized in both the portrait and landscape directions, two microphones are vertically arranged one above the other near the left or right side of the display screen depending on the orientation of the display screen. No isosceles triangle using the mouth of the user as the upper vertex is formed, and thus noise canceling malfunctions.

According to the method disclosed in Jpn. Pat. Appln. KOKAI Publication No. 2002-165292, the user only appropriately selects one of scattered microphones. This method cannot solve the above-mentioned problems.

BRIEF SUMMARY OF THE INVENTION

According to an embodiment of the present invention, an electronic apparatus comprises a display unit having a front surface; a display screen which is incorporated in the display unit and exposed from the front surface; a first microphone and a second microphone which are arranged parallel to one side of the display screen on the front surface so as to be spaced apart from each other; a third microphone which is arranged parallel to another side different from the one side of the display screen on the front surface so as to be spaced apart from either of the first microphone and the second microphone; and a voice input unit configured to execute a voice input process by using two microphones as one of a combination of the first microphone and the second microphone and a combination of the first microphone and the third microphone.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present will be described below with reference to the several views of the accompanying drawing.

Figure 1:
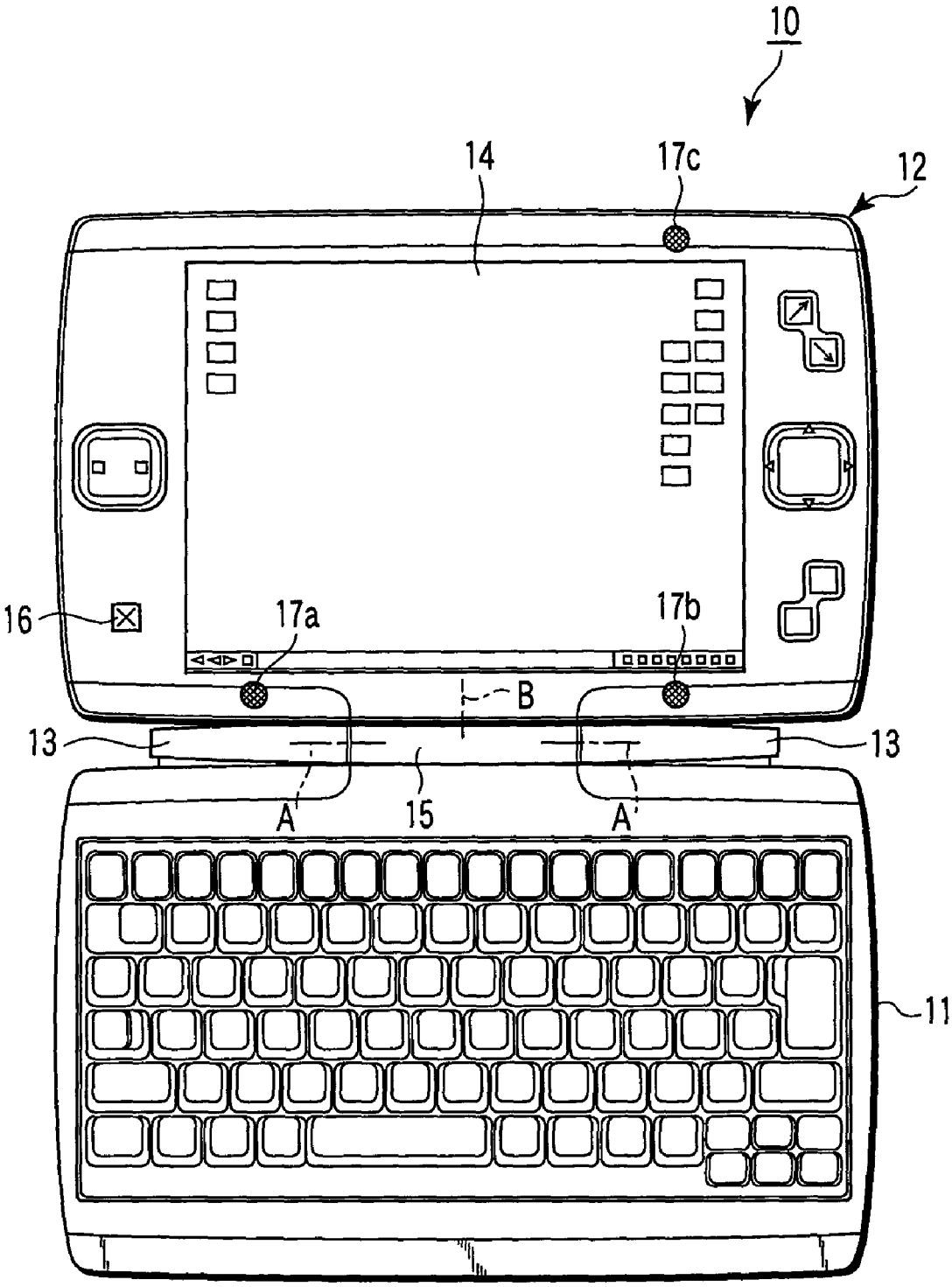
FIG. 1 is a plan view showing the outer appearance of an electronic apparatus in a PC style according to an embodiment of the present invention.

FIG. 1 shows the outer appearance of an electronic apparatus according to the embodiment of the present invention. An electronic apparatus 10 is implemented as a handheld personal computer which is smaller in size than a notebook personal computer.

As shown in FIG. 1, the housing of the electronic apparatus 10 is roughly comprised of two parts: a main body 11 and display unit 12.

The main body 11 is a low-profile rectangular box-like housing, and accommodates various electronic components such as a CPU, memory, chip set, and hard disk drive which form a portable personal computer. A keyboard arrangement region is set on the upper surface of the main body 11, and a keyboard is arranged in the keyboard arrangement region. A pair of hinges 13 are attached to the back end of the main body 11. The pair of hinges 13 are component attaching parts for supporting the display unit 12.

The display unit (display) 12 is also a low-profile rectangular box-like housing, and accommodates a display unit main body. A liquid crystal display (LCD) 14 is assembled in the front surface of the display unit main body so as to expose the display screen. The display screen of the LCD 14 is arranged at almost the center of the display unit 12. The LCD 14 is implemented as a touch screen device capable of recognizing a position designated with a stylus or finger.

A support 15 attached to the center of the bottom of the display unit 12 is supported by the pair of hinges 13 so that the display unit 12 pivots about a first central axis A (pivotal axis) extending parallel to the outer surface of the main body 11. The display unit 12 is pivotally supported between an open position (first open position: shown in FIG. 1) at which the entire upper surface of the main body 11 and the display screen of the LCD 14 on the front surface of the display unit main body are exposed, and a closed position (first state) at which the front surface of the display unit main body covers the upper surface of the main body 11.

Figure 2:
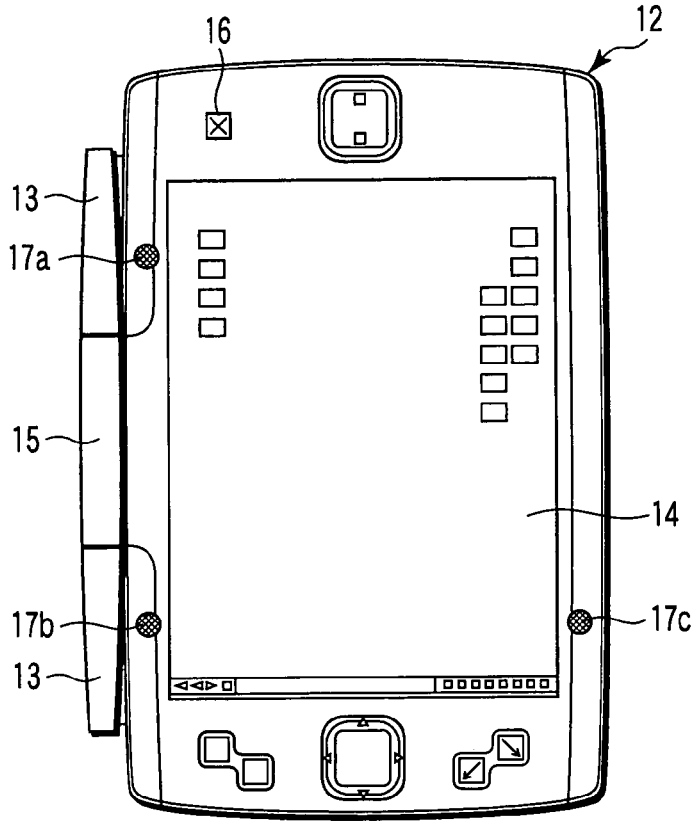
FIG. 2 is a plan view showing the outer appearance of the electronic apparatus in a PDA style (first orientation) according to the embodiment.
Figure 3:
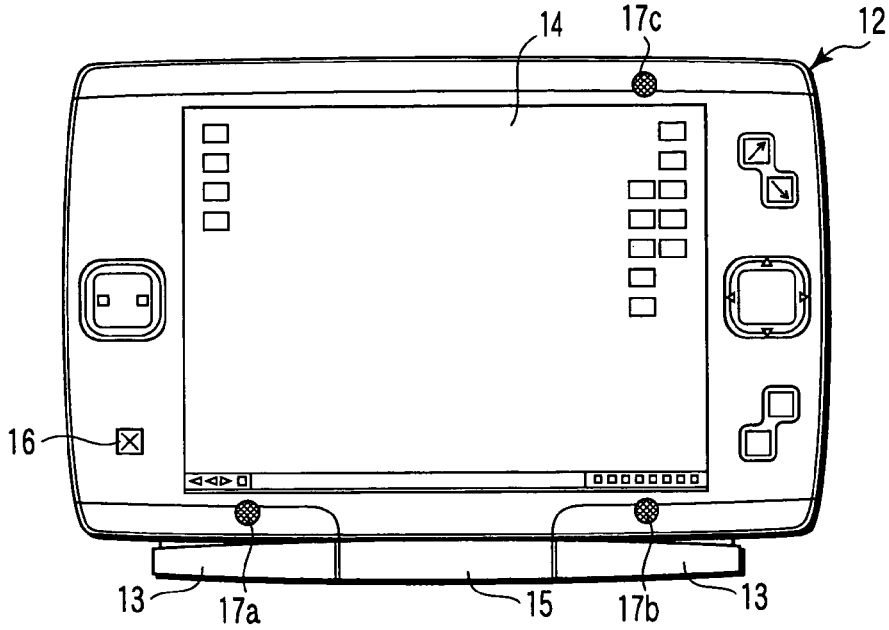
FIG. 3 is a plan view showing the outer appearance of the electronic apparatus in the PDA style (second orientation) according to the embodiment.

Also, the display unit 12 is supported by the support 15 so that the display unit 12 turns about a second central axis B (turning axis) extending from the support 15 to the display unit 12 perpendicularly to the first central axis A. The display unit 12 can horizontally rotate about the second central axis B through 360° with respect to the outer surface of the main body 11. While the display unit 12 is horizontally rotated about the second central axis B through 180° (the rear surface of the display unit main body is oriented to the front side), the display unit 12 is set using the first central axis A as a center to a closed position (second state) at which the display unit 12 covers the entire upper surface of the main body 11. In this case, as shown in FIGS. 2 and 3, the display unit 12 can be arranged at the second open position. At the second open position, the display screen of the LCD 14 on the front surface of the display unit 12 is exposed, and the rear surface of the display unit main body covers the entire upper surface of the main body 11.

That is, when the display unit 12 is set at the first open position (FIG. 1), the user can use the electronic apparatus 10 in the same style (to be also referred to as a PC style hereinafter) as a general notebook-type personal computer. When the display unit 12 is set at the second open position (FIGS. 2 and 3), the user can use the electronic apparatus 10 in the same style (to be also referred to as a PDA style hereinafter) as a general personal digital Assistant (PDA).

When the electronic apparatus 10 is set in the PDA style, the display screen of the LCD 14 can be utilized in the portrait direction (third state), as shown in FIG. 2, or in the landscape direction (fourth state), as shown in FIG. 3. For this purpose, the display unit 12 is equipped with a switch 16 for arbitrarily switching the orientation of the display screen of the LCD 14 by the user.

The electronic apparatus 10 comprises an advanced voice input function of inputting user's voice after canceling noise. Three microphones 17*a* to 17*c* are attached to the display unit 12. The arrangement of the three microphones 17*a* to 17*c* on the display unit 12 is a feature of the electronic apparatus 10, which will be described in detail.

The system configuration of the electronic apparatus 10 will be explained with reference to FIG. 4.

Figure 4:
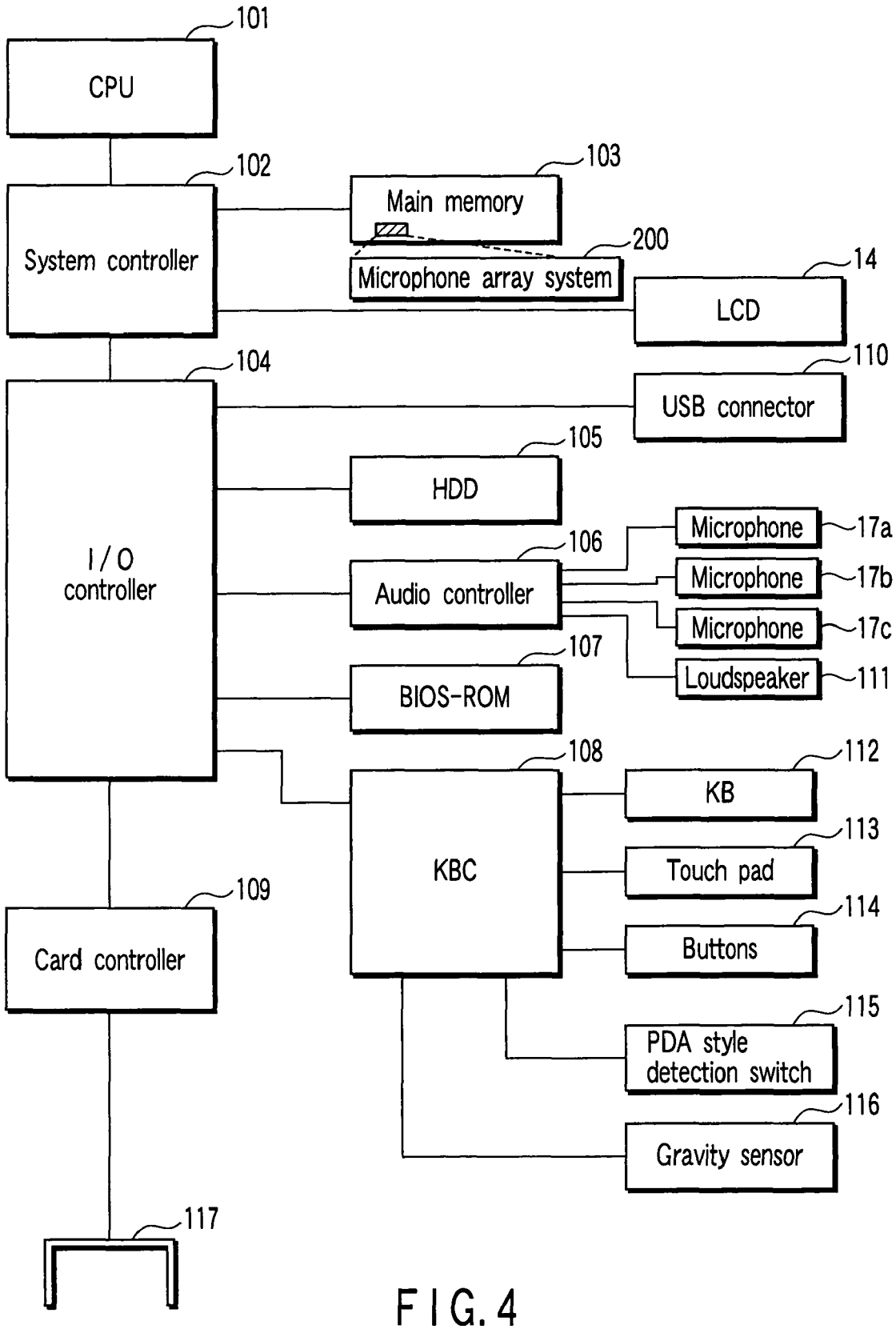
FIG. 4 is a block diagram showing the system configuration of the electronic apparatus according to the embodiment.

As shown in FIG. 4, the main body 11 incorporates a CPU 101, system controller 102, main memory 103, I/O controller 104, hard disk drive (HDD) 105, audio controller 106, BIOS-ROM 107, keyboard controller (KBC) 108, card controller 109, and the like.

The CPU 101 is a processor which controls the operation of the electronic apparatus 10. The CPU 101 executes an operating system and various application programs, including utilities, which are loaded from the HDD 105 into the main memory 103. One of the application programs is a microphone array system 200 (to be described later). The CPU 101 also executes a basic input output system (BIOS) which is stored in the BIOS-ROM 107. The BIOS is a program for controlling various hardware units which form the electronic apparatus 10.

The system controller 102 is a bridge device which connects the CPU 101 and I/O controller 104. The system controller 102 incorporates a memory controller which controls the main memory 103, and a display controller which controls the LCD 14. The I/O controller 104 communicates with each device connected to it under the control of the CPU 101. The I/O controller 104 includes a universal serial bus (USB) host controller, and controls various USB devices connected via a USB connector 110 attached to the main body 11.

Under the control of the CPU 101, the audio controller 106 executes a voice input process of inputting voice signals from the microphones 17*a* to 17*c*, and an audio playback process of outputting an audio signal from a loudspeaker 111. Control of appropriately executing the voice input process is performed by the microphone array system 200.

The KBC 108 is formed from a 1-chip microcomputer, and connected to a keyboard (KB) 112, a touch pad 113, and buttons 114 in order to detect their operations. The switch 16 is one of the buttons 114. The KBC 108 is also electrically connected to a PDA style detection switch 115 and gravity sensor 116. The PDA style detection switch 115 is used to determine whether the display unit 12 is arranged at either the first open position or second open position, i.e., the electronic apparatus 10 is used in either the PC style or PDA style. The gravity sensor 116 is used to determine whether the display screen of the LCD 14 is utilized in the portrait or landscape orientation when the electronic apparatus 10 is determined to be used in the PDA style.

The card controller 109 controls various cards such as a memory card and communication card inserted into a card slot 117 of the main body 11 under the control of the CPU 101.

Figure 5:
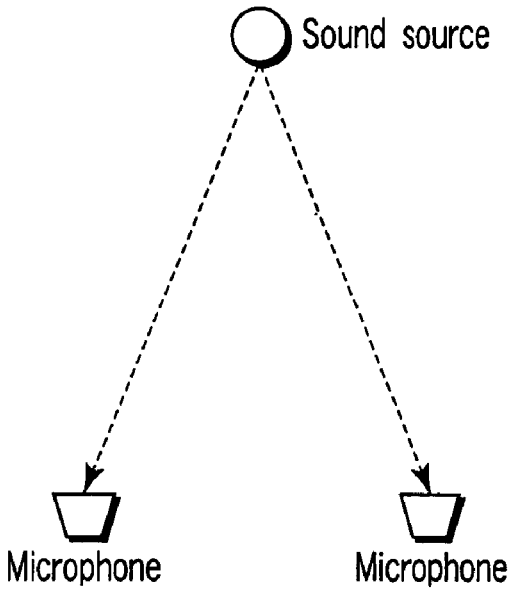
FIG. 5 is a conceptual view for explaining the mechanism of noise canceling executed in the electronic apparatus according to the embodiment.

The operation principle of the microphone array system 200 in the electronic apparatus 10 having the above system configuration will be explained with reference to FIGS. 5 and 6.

The microphone array system 200 is a utility program for providing an advanced voice input function of inputting user's voice after canceling noise. As shown in FIG. 5, the mechanism of the microphone array system 200 is to set two microphones so that they are located at two base vertices of an isosceles triangle virtually drawn using a sound source as the upper vertex, and remove as noise, from sounds input from the two microphones, a sound with a larger difference in volume level between the sounds.

As described above, the electronic apparatus 10 can be used in both the PC style and PDA style. In the PDA style, the display screen of the LCD 14 can be utilized in both the portrait and landscape orientations, as shown in FIGS. 2 and 3. When the PDA style detection switch 115 determines that the electronic apparatus 10 is used in the PDA style, the microphone array system 200 selects two of the three microphones 17*a* to 17*c* in accordance with the detection result of the gravity sensor 116.

Figure 6:
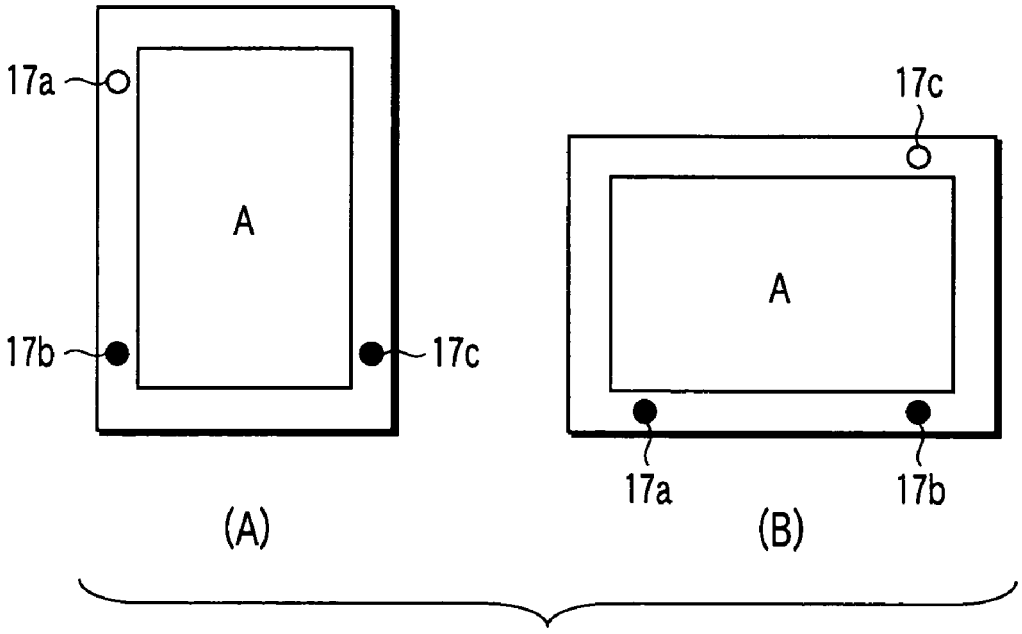
FIG. 6 is a conceptual view for explaining the operation principle of the microphone array system in the electronic apparatus according to the embodiment.

More specifically, as shown in FIG. 6, when the gravity sensor 116 determines that the display screen of the LCD 14 is utilized in the portrait orientation ((A) in FIG. 6), the microphone array system 200 selects the two microphones 17*b* and 17*c*. When the gravity sensor 116 determines that the display screen of the LCD 14 is utilized in the landscape orientation ((B) in FIG. 6), the microphone array system 200 selects the two microphones 17*a* and 17*b*.

In both (A) and (B) of FIG. 6, the mouth of the user who visually observes the display screen of the LCD 14 is estimated to be located on the normal extending from almost the center of one side serving as the bottom of the display screen.

In other words, in both (A) and (B) of FIG. 6, two microphones (microphones 17*b* and 17*c* or microphones 17*a* and 17*b*) spaced apart from each other along the bottom of the display screen of the electronic apparatus 10 are selected. The microphone array system 200 maintains the positional relationship of an isosceles triangle between the mouth of the user and the two microphones. Proper noise canceling can always be executed regardless of the display screen state.

When the PDA style detection switch 115 determines that the electronic apparatus 10 is used in the PDA style, the microphone array system 200 permanently selects the two microphones 17*a* and 17*b*.

When it is detected from the detection result of the gravity sensor 116 that the orientation of the display screen of the LCD 14 has changed, for example, when the orientation in (A) of FIG. 6 is estimated to have changed to that in (B) of FIG. 6, the microphone array system 200 may or may not immediately switch the microphones 17*b* and 17*c* to the microphones 17*a* and 17*b*. When the microphones are not immediately switched, the microphone array system 200 switches the microphones after waiting for, e.g., the operation of the switch 16, that is, a user instruction to switch the orientation of the display screen of the LCD 14. As a result, the microphones are switched in synchronism with switching of the orientation of the display screen of the LCD 14.

Figure 7:
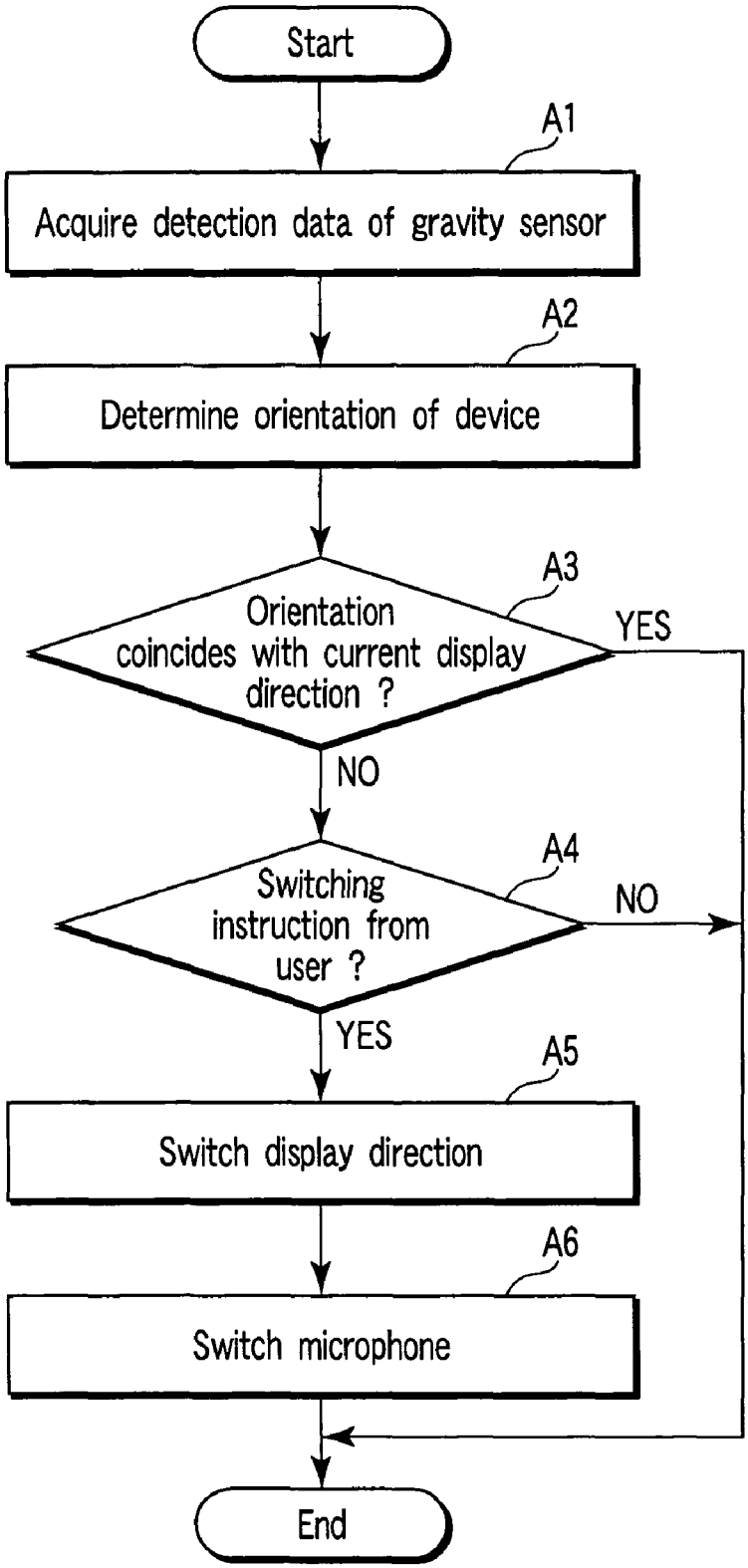
FIG. 7 is a flowchart showing the operation sequence of the microphone array system when the electronic apparatus according to the embodiment is used in the PDA style.

FIG. 7 is a flowchart showing the operation sequence of the microphone array system 200 when the electronic apparatus 10 is used in the PDA style.

The microphone array system 200 acquires the detection result of the gravity sensor 116 (step A1), and determines the orientation of the display screen of the LCD 14 (step A2). The microphone array system 200 then checks whether the orientation of the display screen coincides with the current display direction (step A3). If the orientation of the display screen does not coincide with the current display direction (NO in step A3), the microphone array system 200 checks whether the user issues a display direction switching instruction with the switch 16 (step A4).

If the display direction switching instruction is issued (YES in step A4), the display direction of the LCD 14 is switched (step A5). The microphone array system 200 switches two microphones to be selected in synchronism with switching of the display direction (step A6).

In this manner, the electronic apparatus 10 operates to select the two microphones 17*b* and 17*c* or the two microphones 17*a* and 17*b* from the three microphones 17*a* to 17*c* on the basis of the use style and the orientation of the display screen of the LCD 14. Noise canceling can always appropriately function.

In the above-described embodiment, the microphone array system 200 switches two microphones to be selected on the basis of the detection result of the gravity sensor 116 (and the operation of the switch 16). Two microphones to be selected can also be switched on the basis of only the operation of the switch 16 without verifying the actual orientation of the display screen of the LCD 14 or coping with erroneous user operation. This specification does not require installation of the gravity sensor 116.

The above-described embodiment has exemplified an electronic apparatus which is implemented as a handheld type portable personal computer usable in both the PC style and PDA style. However, the present invention is not limited to this, and the method of the present invention can also be applied to a typical PDA terminal in which the LCD is arranged on the upper surface of a box-like housing.

In the above-described embodiment, two microphones optimal for the positional relationship with the user are selected from three microphones in order to properly cancel noise regardless of the display screen state. The method of the present invention is not limited to this, and can be variously applied such that two loudspeakers optimal for the positional relationship with the user are selected from three loudspeakers in order to properly output a stereoscopic sound regardless of the display screen state.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electronic apparatus comprising:

a display unit having a front surface;

a display screen which is incorporated in the display unit and exposed from the front surface;

a first microphone and a second microphone which are arranged on a first side of the display screen on the front surface so as to be spaced apart from each other;

a third microphone which is arranged on a second side different from the first side of the display screen on the front surface so as to be spaced apart from the first microphone;

a switch for providing an instruction to switch an orientation of the display screen;

a detection unit configured to detect an orientation of the display screen by detecting whether the display unit is utilized in a first direction in which the first side of the display screen serves as a bottom or the display unit is utilized in a second direction in which the second side of the display screen serves as the bottom;

a selection unit configured to:

select, if the detection unit detects that the display unit is utilized in the first direction, the combination of the first microphone and the second microphone; and select, if the detection unit detects that the display unit is utilized in the second direction, a combination of the first microphone and the third microphone;

a voice input unit configured to execute a voice input process including noise canceling by using one of the combination of the first microphone and the second microphone or the combination of the first microphone and the third microphone;

a determination unit configured to determine whether or not the orientation of the display screen detected by the detection unit coincides with a current display direction; and a switching unit configured to switch two microphones to be applied to the voice input process such that one of the combination of the first microphone and the second microphone or the combination of the first microphone and the third microphone selected by the selection unit is applied to the voice input process, when the determination unit determines that the orientation of the display screen detected by the detection unit does not coincide with the current display direction and when the switch provides the instruction.

2. The electronic apparatus according to claim 1, wherein the detection unit comprises a gravity sensor which detects a direction of gravity.

3. The electronic apparatus according to claim 1, wherein the voice input unit is configured to remove from first and second sound inputs a noise sound having a volume level larger than a difference between the volume levels of the first and second sound inputs, the first sound input being received by a first one of the two used microphones, and the second sound input being received by a second one of the two used microphones.

* * * * *